US006482136B1

(12) United States Patent
Kessler

(10) Patent No.: US 6,482,136 B1
(45) Date of Patent: Nov. 19, 2002

(54) WATER-FILLED HOOP CONSTRUCTION

(75) Inventor: Brian D. Kessler, Las Vegas, NV (US)

(73) Assignee: Maui Toys, Inc., Los Angeles, CA (US)

( * ) Notice: Subject to any disclaimer, the term of this patent is extended or adjusted under 35 U.S.C. 154(b) by 0 days.

(21) Appl. No.: 09/395,359

(22) Filed: Sep. 14, 1999

(51) Int. Cl.[7] ..... A63B 23/02; A63H 33/02

(52) U.S. Cl. ..... 482/110; 482/112; 446/28; 446/236; 446/267

(58) Field of Search ..... 482/81, 92, 93, 482/106, 108, 131, 110–113, 132, 148; 446/267, 236, 28, 450–453; 472/133, 135

(56) References Cited

U.S. PATENT DOCUMENTS

| | | | | | |
|---|---|---|---|---|---|
| 2,738,616 | A | * | 3/1956 | Windle | 46/1 |
| 2,979,860 | A | * | 4/1961 | Barta | 46/220 |
| 3,956,851 | A | * | 5/1976 | Tapinekis | 446/267 |
| 3,993,334 | A | * | 11/1976 | Fridman et al. | 285/344 |
| 4,090,324 | A | * | 5/1978 | Compton | 446/236 |
| 4,304,067 | A | * | 12/1981 | Petrosky | 46/220 |
| 4,986,535 | A | * | 1/1991 | Hull et al. | 272/117 |
| 5,629,068 | A | * | 5/1997 | Miekka et al. | 428/148 |
| 5,823,846 | A | * | 10/1998 | Arriola et al. | 446/236 |
| 5,989,097 | A | * | 11/1999 | Lebedz | 446/450 |
| 6,001,048 | A | * | 12/1999 | Taylor | 482/81 |

FOREIGN PATENT DOCUMENTS

| | | | | |
|---|---|---|---|---|
| FR | 1208935 | * | 2/1960 | 428/110 |
| FR | 1.211.877 | * | 3/1960 | 446/28 |

* cited by examiner

*Primary Examiner*—Glenn E. Richman
*Assistant Examiner*—Victor Hwang
(74) *Attorney, Agent, or Firm*—Browdy and Neimark

(57) ABSTRACT

An exercise and/or play hoop, made of semi-rigid plastic tubing, is partially filled with water (30) to between ⅙ and ½ full, most preferably ¼ full. The water improves the dynamics of the hoop and makes keeping the hoop elevated by gyration easier. The hoop is preferably made of a length of hoop tube (10) bent into a circle. A coupling tube (20) is inserted where the ends (11, 12) abut, spanning over the joint. The coupling tube includes a bore (25) through which the liquid flows circumferentially around inside the hoop, and past the joint. To seal the water in O-rings (41, 42) are used. A decorative, preferably iridescent cover (18) may cover the hoop. Tape (50) keeps the joint together. The hoop may be scented.

18 Claims, 1 Drawing Sheet

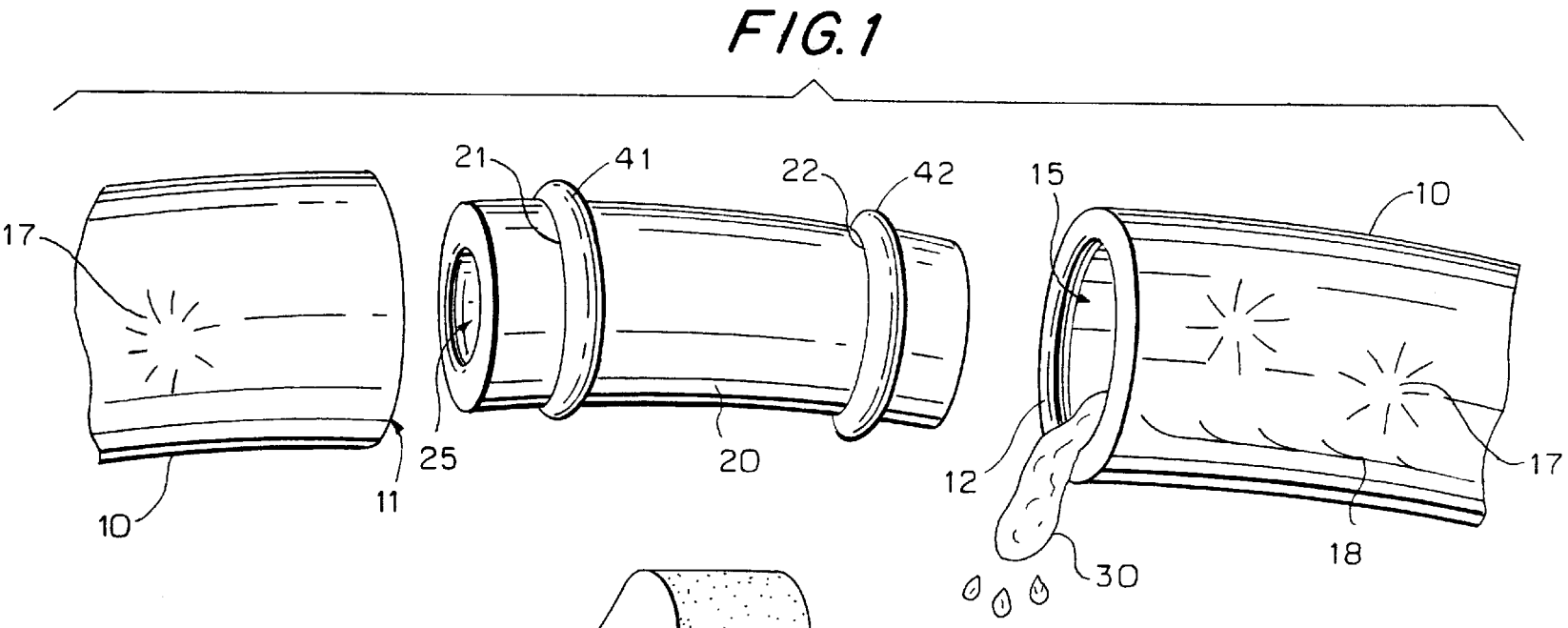
FIG. 1
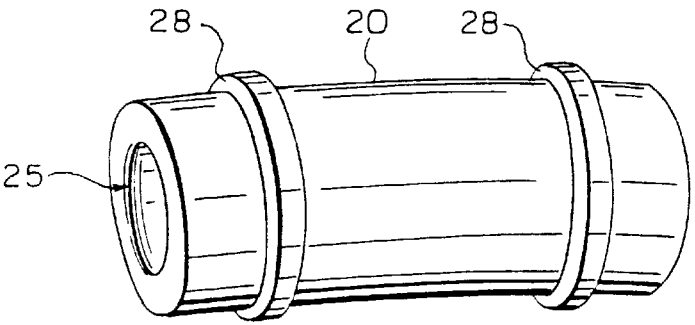
FIG. 2
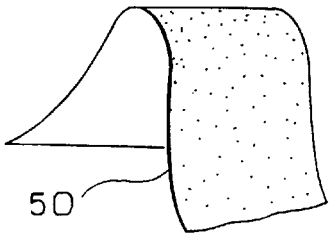
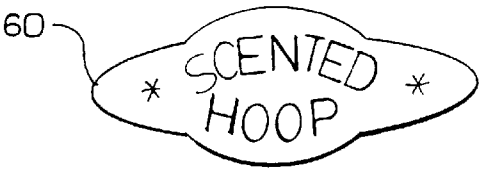

WATER-FILLED HOOP CONSTRUCTION

FIELD OF THE INVENTION

The present invention relates to play and/or exercise hoops of the type known as HULA HOOPS.

DESCRIPTION OF THE RELATED ART

Play hoops are widely known. They are used for rolling and gyrating about the hips and other parts of the body. Hoops are typically made from a length of plastic tubing by bending the length into a circle and joining the ends.

Such hoops do not have any internal damping, which restricts their efficiency. To gyrate a conventional hoop about the hips requires considerable work because the needed rotational speed is quite high.

Another drawback of previous hoops is that they are too light. The conventional hoops can be made of heavier-walled plastic tubing, but this is expensive and makes for difficult bending into the required circular form.

One previous hoop designed by the present applicant had contained water in an attempt to solve these problems, but this earlier liquid-filled hoop was not successful. The water leaked out and the hoop did not function properly.

SUMMARY OF THE INVENTION

An object of the present invention is to provide a play and/or exercise hoop which has internal damping. Another object is to make a hoop which has greater mass without the use of heavier and more expensive materials. Still another object is to provide a hoop with internal inertia shifting.

These objects are met by partially filling a hollow tubular hoop with water or some other liquid, preferably one at least as heavy as water. The trapped water increases the mass, provides internal damping of any motion (especially axial acceleration or deceleration), and leads to novel motions because of the shifting of the water inside.

Unlike the previous water-containing hoop, the circular hoop of the present invention allows the trapped water or liquid to freely circulate all the way around the hoop circumferentially; thus if the hoop is rolled slowly, the liquid remains in the lower part and the rolling motion of the hoop is smooth. The flow of the water around the circumference of the hoop must not be blocked if desirable toy dynamics are to be achieved.

The water filling of the present invention makes the typical HULA-HOOP hip gyration in which the hoop remains elevated, and similar gyrations, easier. This is because the water decreases the rotational speed needed in the hip motion. Centrifugal force causes the water to shift as the circular hoop is rotated or gyrated about the hips, permitting a slower, easier and less tiring rotation.

The water-tight hoop joint of the present invention includes a coupling tube, disposed inside the outer main hoop tube at the joint, having a large bore through which the liquid can freely flow. The coupling tube is preferably adapted for a seal, such as an O-ring, to be placed between the outer wall of the inner coupling and inner wall of the outer hoop tube.

The present invention also contemplates a method of making such a hoop and the construction of such a hoop, so that the hoop is both inexpensive and leak-proof.

BRIEF DESCRIPTION OF THE DRAWING

The above and other objects and the nature and advantages of the present invention will become more apparent from the following detailed description of an embodiment [s] taken in conjunction with drawings, wherein:

FIG. 1 is an exploded perspective view of the invention.

FIG. 2 is a perspective view of an alternative coupling.

DETAILED DESCRIPTION OF THE PREFERRED EMBODIMENT

FIG. 1 shows two ends of a circular hoop tube 10, the ends being labeled as 11 and 12. The ends are shown in exploded view, separated to show the internal coupling tube 20, which is covered when the two ends 11 and 12 are butted together and the hoop is completed in the form of a hoop tube joint. The hoop tube 10 extends in a full circle (not shown) between its two ends 11 and 12, as is conventional in hoops.

The hoop tube 10 is semi-rigid and is preferably made of extruded polyethylene or polyethylene terephthalate glycol (PETG), a type of saturated (i.e. thermoplastic) polyester, having a wall thickness for example of 1 mm. Preferably, the outside is covered with a decorative pattern such as iridescent sparkles 17, of the type employing diffraction rulings to cause scintillating colors. This decoration 17 may be applied in the form of a plastic film 18 wrapped around the hoop tube 10 and adhered to its outside surface. Such films having diffraction rulings may be produced by holographic printing. Other types of exterior decorations are also possible, but the iridescent-like effect produced by the diffraction rulings is particularly striking and therefore most desirable.

A liquid 30 partially fills the interior space 15 of the hoop. Preferably the interior space 15 is filled more than ⅙ full, and less than half full, of the liquid by volume. Still more preferably, the hoop is between ⅙ and ⅔ full of liquid; and an optimum amount of liquid is approximately ¼ full. Less full than ⅙ provides an insufficient effect, and more full than ½ overcomes the desirable inertial shifting effect.

The liquid 30 is preferably water, which may be treated to resist bacterial or fungal growth, to resist freezing, and/or the like. Preferably, the water 30 is scented with a perfume or the like so that the hoop emits a pleasant odor; or the pleasant scent-producing chemical may instead be incorporated into the film 18 or the hoop tube 10 itself.

Other freely flowable materials may be used in place of the liquid 30, although water is preferred as indicated above. For example, ball bearings, most desirably relatively small ball bearings, either alone or together with a liquid, can replace the use of water alone. Other freely flowable materials can be routinely tested for suitability, with the objective that the freely flowing material will flow sufficiently quickly to that part of the hoop opposite, i.e. roughly 180° from, the part of the hoop which is in contact with the user's body during rotation, and with the further objective that the freely flowable material be able to pass quickly through the coupling tube, described below.

To couple the two ends 11 and 12 of the hoop tube 10 together, an inner coupling 20 is provided, preferably in the form of a hard, rigid tube. When the joint is made (not shown), the coupling 20 is roughly centered in the joint, so that the hoop tube ends 11 and 12 abut adjacent the approximate mid-point of the coupling 20. In this position each of the two illustrated O-rings 41, 42 is on one side of the gap where the ends 11 and 12 abut. These O-rings prevent the water 30 from passing from the interior 15 to the joint where it can escape, so that the hoop is maintained watertight. The O-rings 41, 42 are preferably set into annular grooves 21, 22 in the exterior of the coupling 20. However, the coupling tube 20 may be fashioned merely by cutting a short length of preferably hard plastic tubing having the appropriate outer diameter, and sliding O-rings over the ends to be held in place by friction.

An important feature of the present invention is that the water 30 is free to pass through the coupling 20, and so a large diameter through-bore 25 is provided and the coupling 20 takes the form of a coupling tube. The bore 25 allows the water to flow circumferentially around inside the hoop past the joint, so that it does not pile up and ruin the dynamics of the finished hoop. In one embodiment, the inner diameter of the hoop tube 10 is 1.5 cm, and the diameter of the bore 25 is 1.1 cm, and in general the bore 25 should have a cross-sectional area no less than about half the cross-sectional area of the interior of the hoop tube 10 to provide sufficient pass-through of water past the bore 25, especially in the case of hoop tubes having diameter bores no greater than 1.5 cm. However, as the hoop tube diameter increases, this rule becomes increasingly less important.

In those cases where the freely flowable material comprises or consists of solid particles, e.g. ball bearings, it may be desirable to increase the diameter of the bore 25 to more closely approach the inner diameter of the hoop tube 10. If no liquid is present, then the problem of leakage is considerably diminished and there is no need to maintain the hoop water tight, which thus facilitates an increase in size of the bore 25 of the inner coupling 20. In such a case, the wall thickness of the coupling 20 can also be more safely reduced. To further facilitate flow of solid particles into the inner coupling 20 so that such particles can then more freely flow therethrough, the ends of the coupling 20 can be tapered instead of extending radially as shown in FIGS. 1 and 2.

Once the joint is assembled (not shown) the ends 11 and 12 are preferably wrapped with tape 50 all around the joint, to assist in preventing joint separation. To cover the tape 50, a label 60 may be applied.

FIG. 2 shows an alternative embodiment of the coupling tube 20 in which ridges 28 are molded into the exterior so that the seal and the coupling may be unitary. (Here, and in the following claims, "unitary" means formed in one piece, although possibly of more than one material.) These ridges 28, co-molded of elastomeric material with the preferably hard coupling tube, act as liquid seals in place of the O-rings 41, 42. The ridges 28 may be multiplied to form a labyrinth seal, and may also provide mechanical support to align the hoop tube ends 11 and 12 precisely, to avoid a lumpy hoop exterior; one wider central ridge (not shown) may be provided for this purpose. The ridges may be sloped to ease assembly and resist separation of the joint. The ridges may be used in conjunction with O-rings or other sorts of separate gaskets.

The hoop tube 10 and the coupling tube 20 may be glued, welded, or otherwise fastened, and such fastening may comprise a liquid seal.

The cross-sectional shape of the hoop tube may be other than circular, e.g. octagonal, rectangular, ellipsoidal, etc., without departing from the invention. The diameters of both the hoop and the hoop tube may also vary.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means and materials for carrying out various disclosed functions may take a variety of alternative forms without departing from the invention.

Thus the expressions "means to . . . " and "means for . . . " as may be found. in the specification above and/or in the claims below, followed by a functional statement, are intended to define and cover whatever structural, physical, chemical or electrical element or structure may now or in the future exist which carries out the recited function, whether or not precisely equivalent to the embodiment or embodiments disclosed in the specification above; and it is intended that such expressions be given their broadest interpretation.

What is claimed is:

1. A circular hoop for hip gyration comprising:

a polyethylene or polyester hoop tube extending generally in a circle between two ends of the hoop tube, the ends of said hoop tube abutting at a hoop tube joint;

a flowable substance disposed inside the hoop tube, said flowable substance comprising a liquid, and wherein the liquid fills approximately between ⅙ and ½ of the interior space of said hoop tube;

a decorative film covering on the hoop tube, said film being printed with diffraction rulings to provide an iridescent-like appearance;

an inner coupling tube disposed inside the hoop tube and spanning the joint, the coupling tube including a bore through which the flowable substance is freely flowable circumferentially in the hoop past the joint; and a seal preventing the flowable substance from leaking between the coupling tube and the hoop tube and through the hoop tube joint.

2. The hoop according to claim 1, wherein the seal comprises a pair of O-rings between an outer surface of the coupling tube and an inner surface of the hoop tube, with one O-ring disposed on either side of the joint.

3. The hoop according to claim 2, wherein the O-rings are stretched over the outer surface of the coupling tube and are compressed by the inner surface of the hoop tube.

4. The hoop according to claim 1, wherein the seal comprises ridges on the coupling tube.

5. The hoop according to claim 1, wherein the liquid fills approximately between ⅙ and ⅖ of the interior space of the hoop.

6. The hoop according to claim 1, wherein the liquid fills approximately ¼ of the interior space of the hoop.

7. The hoop according to claim 1, wherein the cross-sectional area of the bore is not less than ½ the cross-sectional area of the hoop tube interior.

8. The hoop according to claim 1 wherein the circular hoop is scented.

9. A circular hoop for hip gyration comprising:

a hoop tube extending generally in a circle between two ends of the hoop tube, the ends abutting at a hoop tube joint, said hoop tube being formed of polyethylene or polyester;

a flowable liquid substance disposed inside the hoop tube in an amount between ⅙ and ½ of the interior space of the hoop tube;

an inner coupling tube disposed inside the outer tube and spanning over the joint, the coupling tube including a bore through which the flowable liquid substance is freely flowable circumferentially in the hoop past the joint, wherein the cross-sectional area of the bore is not less than ½ the cross-sectional area of the hoop tube interior;

a seal preventing the flowable liquid substance from leaking between the coupling tube and the hoop tube and through the hoop tube joint; and a decorative film covering on the hoop tube, said decorative film being printed with diffraction rulings to provide an iridescent-like appearance.

10. The hoop according to claim 9, wherein the flowable liquid substance comprises water and wherein said flowable substance fills approximately between ⅙ and ⅖ of the interior space of the hoop.

11. The hoop according to claim 10, wherein the flowable liquid substance fills approximately ¼ of the interior space of the hoop.

12. The hoop according to claim 9, wherein the seal comprises a pair of O-rings between an outer surface of the coupling tube and an inner surface of the hoop tube, with one O-ring disposed on either side of the joint.

13. The hoop according to claim 12, wherein the O-rings are stretched over the outer surface of the coupling tube and are compressed by the inner surface of the hoop tube.

14. The hoop according to claim 9, wherein the seal comprises ridges on the coupling tube.

15. The hoop according to claim 9 wherein said hoop is scented.

16. In a circular exercise and play hoop for a repetitive motion method wherein a user rotates said exercise and play hoop above his or her hips by gyrating said hips, said circular play hoop comprising:

a hoop tube extending generally in a circle between two ends thereof, the ends abutting at a hoop tube joint, and liquid disposed inside the hoop tube, the improvement wherein said hoop tube is formed of polyethylene or polyester, and said hoop further comprises a decorative film covering on the hoop tube, said film being printed with diffraction rulings to provide an iridescent-like appearance;

wherein the liquid fills approximately ⅙ to ⅖ of the interior space of the hoop tube; and said hoop tube joint is sealed to prevent leakage of said liquid disposed inside the hoop tube, and has an internal bore sufficiently large to permit said liquid disposed inside said hoop tube to freely flow therethrough, said bore having a cross-sectional area not less than ½ the cross-sectional area of the hoop tube interior.

17. In a repetitive motion method wherein a user rotates a circular hoop above his or her hips by gyrating said hips, the improvement wherein said circular hoop comprises:

a hoop tube extending generally in a circle between two ends of the hoop tube, the ends abutting at a hoop tube joint;

a decorative film covering the hoop tube, said film being printed with diffraction rulings to provide an iridescent appearance;

a flowable substance comprising water disposed inside the hoop tube, wherein the flowable substance fills approximately between ⅙ and ⅖ of the interior space of the hoop tube;

an inner coupling tube disposed inside the outer tube and spanning over the joint, the coupling tube including a bore, said bore having a cross-sectional area not less than one-half the cross-sectional area of the hoop tube interior, said bore permitting the flowable substance comprising water to freely flow circumferentially in the hoop past the joint; and a seal preventing the flowable substance from leaking between the coupling tube and the hoop tube and through the hoop tube joint.

18. The method of claim 17 wherein said hoop tube is formed of polyethylene or polyester.

* * * * *